United States Patent [19]

Miller, Jr.

[11] 3,978,554

[45] Sept. 7, 1976

[54] SPRING CLIP FASTENED PANEL AND FRAME ASSEMBLY

[76] Inventor: Samuel Miller, Jr., 4106 Camelot, Memphis, Tenn. 38118

[22] Filed: Mar. 27, 1975

[21] Appl. No.: 562,781

[52] U.S. Cl. ..... 24/73 B; 49/463

[51] Int. Cl.[2] ..... A44B 21/00; E06B 3/32

[58] Field of Search ..... 24/73 B; 160/369; 49/463

[56] References Cited

UNITED STATES PATENTS

| | | | |
|---|---|---|---|
| 2,537,930 | 1/1951 | Hall | 24/73 B |
| 2,837,784 | 6/1958 | Jannette | 49/463 |
| 2,865,063 | 12/1958 | Hartshorov | 24/73 B |
| 3,082,665 | 3/1963 | Jackson | 24/73 B |

FOREIGN PATENTS OR APPLICATIONS

| | | | |
|---|---|---|---|
| 1,188,258 | 9/1959 | France | 24/73 B |
| 1,009,056 | 11/1965 | United Kingdom | 24/73 B |
| 947,385 | 1/1964 | United Kingdom | 24/73 B |
| 867,420 | 5/1961 | United Kingdom | 24/73 B |

*Primary Examiner*—Paul R. Gilliam
*Assistant Examiner*—Victor N. Sakran
*Attorney, Agent, or Firm*—Mason, Fenwick & Lawrence

[57] ABSTRACT

A spring clip fastened panel for furniture and the like is disclosed comprising a frame forming a surround about a recess for receiving a panel, said frame having inwardly facing edge surfaces bounding the recess and shaped to define a retaining lip to support a panel in the recess. A panel fits into the recess and is supported against the retaining lip. The edge surfaces include a groove in the plane of the panel, and generally U-shaped spring clips having first legs which are inserted in the grooves along approximately diagonal paths inclined to the plane of the grooves and retained in a stressed condition in the grooves by second legs integrally joined to the first legs and having lips at their ends which press against the edge of the panel thereby retaining the panel in the recess.

2 Claims, 4 Drawing Figures

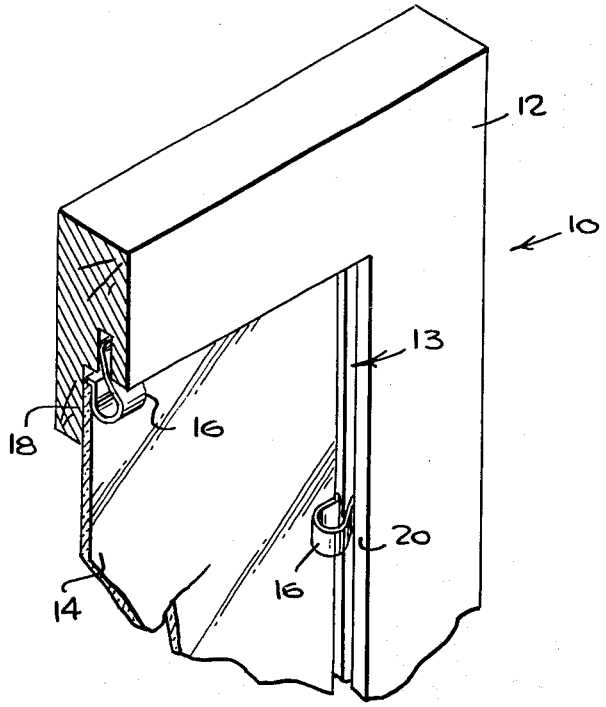
Fig-1
Fig-2
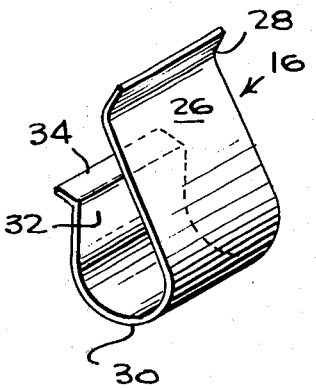
Fig-3
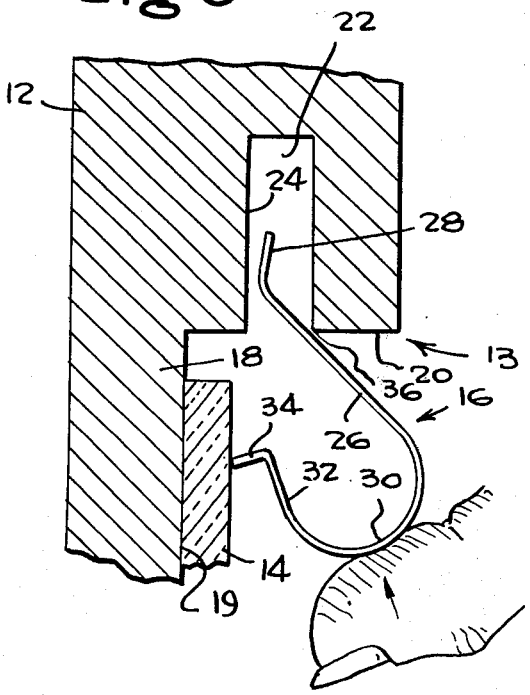
Fig-4
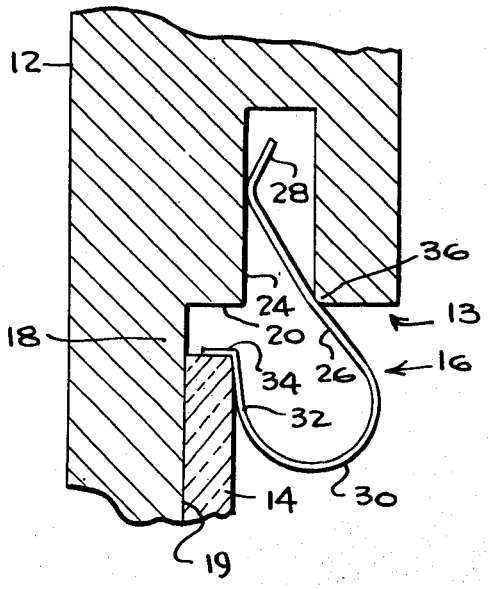

SPRING CLIP FASTENED PANEL AND FRAME ASSEMBLY

BACKGROUND AND OBJECTS OF THE INVENTION

This invention relates to the installation of panels in frames and more specifically to the installation of ornamental panels and mirrors in frame portions of furniture.

There has existed for many years in the furniture manufacturing field a continuing need for an efficient and economical device to attach ornamental panels or mirrors in recesses in furniture. Frequently, clamping blocks, which overlap the panel, are drilled and screwed to the frame members surrounding the panel to lock the panel in position. This method of assembly requires the use of screws to retain the panel in position, a screwdriver for installing the screw in the retaining block, a jig or fixture for positioning the screws and the blocks, and the provision of predrilled screw holes in the blocks to speed assembly. This method of assembly is slow because of the substantial amount of time required to insert the screws after assembling all of the various pieces and positioning them with jigs or fixtures. The screw head and clamping blocks do not produce an attractive installation when the clamping blocks are visible. Additionally, a high percentage of rejects frequently results from accidents occasioned by the manual use of tools and screws in this type of installation.

An alternative to the screw and clamping block installation has been the application of hot glue to the clamping blocks thereby eliminating the need for intalling screws. Unfortunately, this method of installation is extremely unsightly and the glass, mirror or panel which is being retained by the glued blocks is not easily removed or replaced without damage to the various parts.

None of the previously known methods of installing panels has prevented vibration or rattling of the panels if the various components loosen or shrink. The previous methods of installing panels have been relatively slow and have required a relatively high level of skill by the installer to produce neat installations with an acceptable level of rejects. These previous known methods of installing panels do not produce a sufficiently attractive appearance to permit exposure of the clamping devices to the view of the user unless a high level of expense is incurred in providing attractive clamping blocks and screws and in exercising a high degree of care in installing the screws in the clamping blocks.

These previously known installations have resulted in clamping devices which project above the frames surrounding the panels thereby resulting in clearances between the frames and adjacent surfaces. These projecting clamps create an unattractive appearance for the assemblies and therefore must be covered or located in unexposed areas which greatly limits the flexibility in designing panel installations.

Therefore, it is the primary object of this invention to provide a new and improved panel installation for furniture and the like.

Another object of the present invention is to provide a panel installation which reduces the high labor costs associated with previous panel installations.

A further object of the present invention is to provide a panel installation which is attractive in appearance when the clamping device is exposed.

A still further object of the present invention is to provide a panel installation for retaining glass, mirrors, or panels in a frame by holding members under continuous resilient stress conditions which prevent any rattling due to the loosening or shrinkage of the various components.

Another object of the present invention is to provide a panel installation which may be assembled by hand without requiring any tools, jigs or fixtures.

An additional object of the present invention is to provide a panel installation which will result in a very low number of rejects.

A further additional object of the present invention is to provide a panel installation in which the removal and reinstallation of panels can be accomplished quickly by hand.

Achievement of the objects of this invention is enabled through the provision of a frame surrounding a recess for receiving a panel, said frame having inwardly facing edge portion along the top, bottom and side frame members defining a retaining lip forming a rear abutment surface to support in the recess a panel of glass, plywood or the like having edges which fit into the recess and rest against the retaining lip. The inner edge portions of the frame members has a groove parallel to the plane of the panel and generally U-shaped spring clip fasteners having first legs which are inclined to the plane of the groove and extend into the groove and second legs which are joined to the first legs and have lips at the ends thereof which press against the edge of the panel to retain the first legs in a stressed condition in the groove.

A better understanding of the manner in which the preferred embodiment of the subject invention achieves the objects of the invention will be enabled when the following written description is read in conjunction with the appended drawings.

BRIEF DESCRIPTION OF THE FIGURES

FIG. 1 is a fragmentary perspective view of the preferred embodiment of present invention showing the spring clip fasteners installed in the groove in the frame;

FIG. 2 is a perspective view of the spring clip fastener of the present invention;

FIG. 3 is a sectional view through a portion of the frame showing the spring clip fastener being installed in the groove in the frame; and FIG. 4 is a sectional view showing the spring clip completely installed in the groove with the first leg of the spring clip in a stressed condition in the groove and the lip on the second leg pressed against the edge of the panel.

DETAILED DESCRIPTION OF A PREFERRED EMBODIMENT

Referring to the drawing, wherein like reference characters designate corresponding parts throughout the several Figures, there is shown in FIG. 1 a panel installation 10 which includes a frame 12, which is generally fabricated of wood or plastic, forming a surround about a forwardly opening recess 13 receiving a panel 14 which may be glass, masonite, plywood, or the like. The panel 14 is held in the recess 13 by spring clip fasteners 16 which are preferably made of spring steel, although brass, plastic, or other materials may be used.

The inwardly facing edges 20 of the top, bottom and side frame members defining the frame or surround are shaped to provide a retaining lip 18 with suppport surface 19 which extends inwardly from the inner edges 20 of the frame 12 and provides a forwardly facing shoulder surface to support the panel 14 as shown in FIGS. 1, 3 and 4. The inner edges 20 of the frame are dimensioned to provide a loose fit for the panel 14 in the recess 13 with a small clearance around the outer edges of the panel 14 as shown in FIGS. 1, 3 and 4 to permit proper installation of the spring clip fastener 16. The inner frame edges 20 are shaped to provide a narrow groove 22 which extends around the frame parallel to the panel 14. The groove 22 has a rear wall 24 displaced from the surface 19 of retaining lip 18 by a distance approximately equal to or slightly greater than the thickness of the panel 14 as shown in FIGS. 3 and 4. The width of the groove 22 is sufficient to place the spring clip fastener 16 in a stressed condition and has a depth sufficient to permit the spring clip fastener 16 to be inserted to an approximately diagonal position in the groove as shown in FIGS. 1 and 4.

The spring clip fastener 16 is preferably formed from a straight width of thin spring steel stock. The fastener is U-shaped to define a generally straight first leg 26 with an inclined foot portion 28 to permit easy insertion of the first leg 26 into the groove 22 without having the end of the first leg cut or catch upon the inner wall 24. The foot portion 28 therefore simplifies the insertion and removal of the spring clip fastener. An arcuately curved convex intermediate portion 30, which forms the base of the U, joins the first leg to a second leg 32 which is shorter than the first leg. The second leg terminates at its free end in a right angle lip 34 extending outwardly away from the first leg and is formed by bending the end of the second leg at a right angle.

Installation of the spring clip fastener is quickly and efficiently performed after the panel 14 is inserted into the recess 13 of the frame 12 and positioned against the surface 19 of retaining lip 18. The spring clip fasteners 16 are grasped manually by the installer and positioned as shown in FIG. 3 in the groove 22 and then pressed by finger pressure into the groove until the lip 34 seats against the edge of the panel 14 as shown in FIG. 4. In this position, the first leg 26 is flexed slightly against the edge 36 of the groove 22 as shown in FIG. 4, thereby placing the spring clip fastener 16 in a stressed condition to apply a biasing force against the panel 14 which holds the panel against the retaining lip 18. Flexing the spring clip fastener to position the right angle lip 34 against the edge of the panel 14 provides a biasing force toward the center of the recess 13 from the inner frame edges 20 which prevents any vibration or movement of the panel 14 relative to the frame 12.

Removing the spring clip fastener is essentially accomplished by reversing the process of installing the spring clip fastener. The installer simply applies moderate pressure at portion 16 with the thumb in a downwardly and forward direction toward the panel 14 and away from the groove 22 thereby raising lip 34 from the edge of panel 14 and thereby fully releasing the spring clip fastener. As can be seen, the removal and insertion of the spring clip fastener is quickly and easily accomplished without damage to the frame, the panel or the spring clip.

It is to be understood that numerous modifications of the disclosed embodiments of the subject invention will undoubtedly occur to those with skill in the art and the spirit and scope of the invention is limited solely in light of the appended claims.

I claim:

1. A spring clip fastened panel and frame assembly for furniture and the like, said assembly comprising a frame having frame members defining a recess bounded by inwardly facing edge surfaces of the frame members and a support lip extending inwardly from at least one of said edge surfaces, a panel smaller than the recess positioned in the recess and against the suppport lip, the frame members having a groove extending into at least one of said edge surfaces having front and rear groove side walls, and at least one spring clip fastener having a first leg positioned in said groove along an approximately diagonal path inclined to the plane of the groove, a second leg and an arcuately curved convex intermediate portion integrally joining the second leg to the first leg, the first leg having a distal portion spaced inwardly of the groove from the entrance to the groove bearing against the rear groove side wall and having a proximal portion abutting the front groove side wall at the entrance of the groove and stressed toward the rear groove side wall from its normal path, said second leg having a formation at its free end positioned against the panel to retain the panel against relative movement with respect to said formation and thereby retaining the first leg in the groove.

2. The spring clip fastened panel and frame assembly as defined in claim 1 wherein the spring clip fastener is formed of a thin, stiff material, the first leg is generally straight, the second leg is shorter than the first leg and directed at an angle toward the first leg and said formation includes a lip at the free end of the second leg which may be positioned against the edge of the panel thereby retaining the first leg in the groove.

* * * * *